United States Patent [19]

Eastridge et al.

[11] Patent Number: 4,516,587

[45] Date of Patent: May 14, 1985

[54] CIGARETTE EXTINGUISHER

[76] Inventors: Victor R. Eastridge; John C. Milani, both of P.O. Box 3291, Scottsdale, Ariz. 85257

[21] Appl. No.: 496,859

[22] Filed: May 23, 1983

[51] Int. Cl.[3] ..... A24F 13/18

[52] U.S. Cl. ..... 131/256; 131/235.1

[58] Field of Search ..... 131/256, 235 R; D27/8, D27/9

[56] References Cited

U.S. PATENT DOCUMENTS 4,055,193 10/1977 Lehman ..... 131/256

*Primary Examiner*—V. Millin

*Attorney, Agent, or Firm*—Herbert E. Haynes, Jr.

[57] ABSTRACT

A cigarette extinguishing device including a housing having an axial bore formed therethrough for removably receiving a cigarette to be extinguished with the bore being especially configured to rapidly extinguish the cigarette without crushing or otherwise breaking up the burning cigarette tip and with minimal ash dislodgement.

10 Claims, 4 Drawing Figures

CIGARETTE EXTINGUISHER

BACKGROUND OF THE INVENTION

1. Field of the Invention

This invention relates in general to devices for extinguishing burning materials and more particularly to a device for positively extinguishing cigarettes.

2. Description of the Prior Art

As is well known, conventional extinguishing of a cigarette in an ash tray involves a crushing action which breaks up and scatters the ashes and burning embers of the cigarette and smothers whatever burning residue remains attached to the cigarette. Such a crushing operation is by no means a positive extinguishing action in that it often requires several individual tampings to achieve a complete extinguishing. Unless care is exercised, complete extinguishing of the cigarette may not be accomplished which, in addition to being a fire hazzard, is a very irritating occurrence with regard to the smell and continuing emission of smoke. This type of extinguishing technique is bad enough in all situations, but can be dangerous when the operator of an automotive vehicle becomes distracted by the attention he must direct to this crushing type of cigarette extinguishing operation.

For those reasons, several attempts have been made to develop devices which are generally referred to as "snubbers". Basically speaking, snubber devices fall into two categories, those which simply restrict the oxygen flow to the burning cigarette end by confining it in a limited oxygen flow enclosure, and those which confine the crushing action within a specific area and simultaneously restrict the oxygen flow.

U.S. Pat. No. 2,764,165 discloses a cigarette snubbing device of the above mentioned first catagory, wherein oxygen flow restriction is the sole means relied on to extinguish a cigarette. This prior art snubbing device includes a body having a bore formed vertically therethrough. The bore is chamfered at its upper end for ease of insertion of the lit end of a cigarette into a passage which is slightly tapered and extends through the body. The snubber of this patent is used in an ash tray the bottom surface of which must be proximate the open bottom end of the passage to restrict the flow of oxygen to the burning tip of the cigarette when it is inserted into the tapered lower bore of the passage. In this type of snubber, the time required to extinguish the cigarette is determined by the amount of oxygen which enters the bottom of the bore through the annular gap between the body and the bottom surface of the ash tray. If that gap is small enough to cause a cigarette to be extinguished within an acceptable time, the passage will be difficult to clean in that a dislodged ash build-up will occur in the passage. On the other hand, if the gap is large enough to facilitate cleaning out of the dislodged ashes, the flow of oxygen will not be reduced sufficiently to produce a satisfactory extinguishing time.

U.S. Pat. No. 3,491,773 discloses a snubber of the above described second catagory, wherein restricted oxygen flow and a crushing action are combined for extinguishing purposes. The structure of this patent includes a body with a cylindrical cigarette receiving bore formed therethrough. The bore is chamfered at its upper end for ease of cigarette insertion and has an annular ledge which circumscribes a reduced diameter opening in the bottom of the body. The main portion of the cylindrical bore although loose is a relatively tight fit with the outside diameter of the cigarette and restricts the oxygen flow to the cigarette and the annular ledge performs limited crushing and tip dislodgement actions. The main action in this particular device which results in extinguishing of the cigarette is the limited crushing and tip dislodgement. The burning embers which are dislodged can continue to burn for a time after falling from the device and this time can be sufficient to reignite cigarettes which were previously extinguished and deposited in the ash tray and can continue to smell and emit smoke.

U.S. Pat. No. 2,748,778 is another cigarette extinguisher of the second catagory discussed above. In this device, the body defines a cup-shaped cavity with an enlarged upper open end with an endless depending sidewall which curves downwardly to a restricted bottom opening passage. The snubbing action of this device is almost entirely a crushing and tip dislodgement operation due to the downwardly curving cup-shaped cavity into which the burning tip of the cigarette is wedgingly inserted.

Although the above described prior art snubbers are an improvement over the conventional crushing operation, they do not entirely eliminate the fire safety hazzard problem, the continued smell and smoke emission problem, and they can dangerously divert the attention of an operator of an automotive vehicle.

Therefore, a need exists for a new and improved cigarette extinguisher which overcomes some of the problems and shortcomings of the prior art.

SUMMARY OF THE INVENTION

In accordance with the present invention, a new and improved cigarette extinguishing device is disclosed which comprises a housing, or body, having an especially configured bore formed therethrough which is shaped to nestingly receive the burning tip of a cigarette inserted therein and rapidly extinguish it without scattering any burning embers.

The special bore of the extinguishing device is chamfered at its upper end to facilitate insertion of the cigarette to be extinguished therein. The chamfered upper opening opens downwardly into a cylindrical bore which has an axial depth that is sufficient to support the inserted cigarette therein. The lower end of the cylindrical bore terminates in an inverted frusto-conical portion which is shaped to closely conform to the shape of the burning tip of the cigarette, and the lower end of the frusto-conical portion opens into a downwardly extending reduced diameter cylindrical bore which opens onto the bottom surface of the extinguisher body.

When a cigarette to be extinguished is inserted in the device of the present invention without any wedging or other forces being applied thereto beyond what is needed for insertion, the burning cigarette tip and the ashes carried thereon will be nestingly received in the frusto-conical portion of the special bore. Since the frusto-conical portion of the bore is configured to substantially match the shape of the burning tip, which is inherently formed on a normally burning cigarette, there will be no breaking up or scattering of the burning tobacco and, in fact, there will be very little dislodging of the ashes carried on the cigarette. As a result of the nesting receipt of the burning cigarette tip in the special bore, the cigarette will be extinguished very rapidly, however, exactly what occurs is unknown.

It is believed that the device utilizes several factors which combine to provide its extinguishing characteristics. First, the flow of oxygen is restricted to the burning cigarette tip by virtue of the bore, but it is not completely shut off by the bore itself in that it is open at both ends. The nestingly resting placement of the burning tip in the frusto-conical portion of the bore is believed to produce a compacting, or compressing, effect on the ashes carried by the cigarette and thereby form what may be described as an oxygen flow restricting shell which encapsulates a large portion of the area of the burning cigarette tip. Such a compacted shell in combination with the inherent oxygen flow restriction provided by the bore is believed to quickly starve the burning cigarette tip of the oxygen needed for continued combustion. Further, the body of the device will be at or near room temperature prior to an extinguishing operation and this in conjunction with the compacting of the relatively cooler ashes about the burning cigarette tip will cause a rapid drop in the temperature thereof. It is believed that when such cooling occurs, the molten liquids, such as the tars and nicotine, will cool and solidify rapidly and thus further contribute to the rapid extinguishing of the cigarette.

Accordingly, it is an object of the present invention to provide a new and improved cigarette extinguishing device which overcomes some of the problems and disadvantages of the prior art.

Another object of the present invention is to provide a new and improved cigarette extinguishing device which very rapidly extinguishes a burning cigarette without crushing or otherwise breaking up and scattering any burning embers.

Another object of the present invention is to provide a new and improved cigarette extinguishing device which extinguishes the cigarette with minimal ash dislodgement.

Another object of the present invention is to provide a new and improved cigarette extinguishing device of the above described character which is simple to manufacture and easy to use in that it may be used with minimal distraction of the person utilizing the device.

Another object of the present invention is to provide a cigarette extinguishing device of the above described character which includes an especially configured bore formed through the extinguisher body for nestingly receiving the cigarette to be extinguished.

Another object of the present invention is to provide a cigarette extinguishing device of the above described type wherein the special bore includes an axially elongated cylindrical bore portion for supporting the inserted cigarette with the lower end of the cylindrical bore being of an inverted frusto-conical configuration which substantially matches the inherent shape of the burning tip of the cigarette which is nestingly receivable therein.

The foregoing and other objects of the present invention, as well as the invention itself, may be more fully understood from the following description when read in conjunction with the accompanying drawings.

DESCRIPTION OF THE PREFERRED EMBODIMENT

Figure 1:
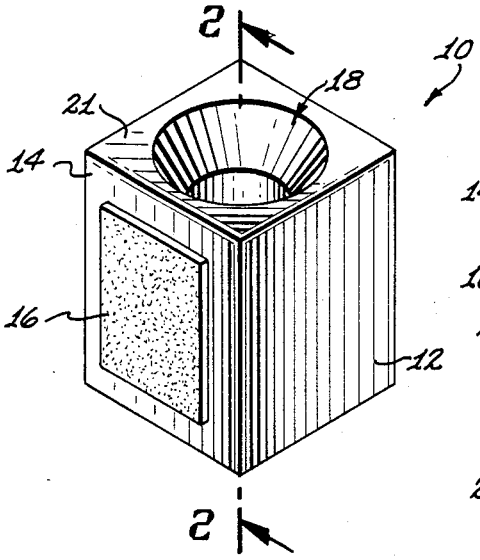
FIG. 1 is a perspective view of the cigarette extinguishing device of the present invention.

Referring more particularly to the drawings, FIG. 1 shows the cigarette extinguishing device of the present invention which is indicated in its entirety by the reference numeral 10. The extinguisher 10 includes a body 12 the exterior configuration of which may be of any convenient shape, such as a cube, cylinder, or the like. It is preferred that whatever the exterior configuration may be, at least one substantially flat sidewall segment, such as the one shown at 14, be formed on the periphery of the body 12 to facilitate mounting thereof on any convenient surface (not shown) such as the interior of an ash tray. As will hereinafter be described in detail, the extinguisher device 10 will not crush or otherwise break up and distribute burning embers from a cigarette being extinguished therein, and in fact will extinguish a cigarette with minimal ash dislodgement. Therefore, the extinguisher device 10 need not always be mounted within an ash tray and can, for example, be mounted on the side of a desk, on a door frame, or the like.

In any event, the extinguisher device 10 may be mounted on any suitable surface by utilizing fasteners, such as screws, or may be affixed with an adhesive. By way of example, the extinguisher device 10 is shown as being provided with a double sided adhesive tape 16 by which it may be mounted.

The body of the extinguisher device 10 may be formed of metal, hard wood, or virtually any other material which is capable of being formed into the desired bore configuration and holding that shape. It has been found that due to the very rapid cigarette extinguishing characteristics of the extinguisher device 10, the body 12 may be formed of a suitable plastic, such as polycarbonate, polyvinyl chloride, and the like.

Figure 2:
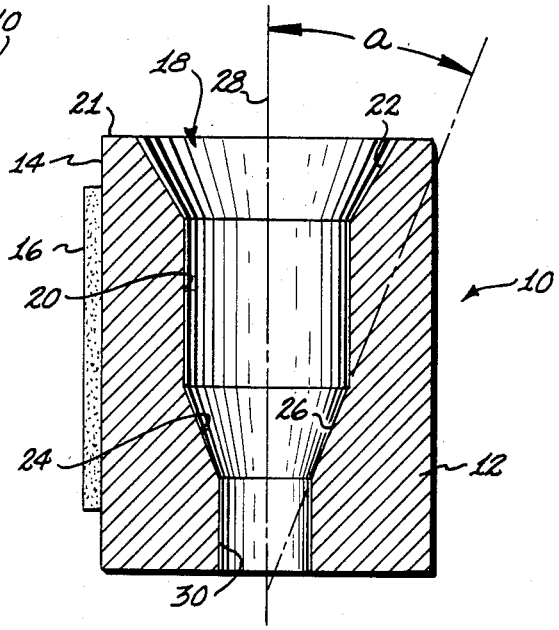
FIG. 2 is an enlarged sectional view taken along the line 2—2 of FIG. 1.

As seen best in FIG. 2, the extinguisher body 12 has a bore 18 of special configuration formed therethrough for receiving the cigarette to be extinguished. The bore 18 includes a cylindrical bore portion 20 which extends vertically downwardly from the upper surface 21 of the body 12 with the upper end of the cylindrical bore portion 20 being chamfered as at 22. The angle and depth of the chamfer is not important as far as the extinguishing characteristics of the device 10 are concerned, in that its sole function is to facilitate insertion into the bore 18 of a cigarette to be extinguished. The cylindrical bore portion 20 is provided with a depth that is sufficient to support a cigarette which is axially inserted therein and has a diameter which will allow the cigarette to axially move freely therein without allowing any excess airflow therethrough when the cigarette is disposed therein.

The lower end of the cylindrical bore portion 20 is configured to define an inverted frusto-conical bore portion 24 which is designed to nestingly receive the burning tip of an inserted cigarette. To accomplish the desired nesting relationship between the frusto-conical bore portion 24 and the burning tip of a cigarette, the shape of the frusto-conical bore portion is fabricated to closely conform to the shape of the burning tip which is inherently of conical shape in a normally burning cigarette. It has been determined by experimentation that if the slant elements of the frusto-conical bore portion form an angle in the range of about 15° to 25° with respect to the height, or axis, of that bore, the bore portion 24 will substantially match the shape of the burning tip of a cigarette and the desired nesting relationship will be achieved.

To insure a clear understanding of the above mentioned angular relationship, the well known and generally accepted description of a right circular cone will be used. A right circular cone is also called a cone of revolution because it may be generated by revolving a right triangle about one of its legs as an axis. The elements, sometimes referred as the slant elements, are the segments representing various positions of the hypotenuse of the revolving right triangle. Therefore, in FIG. 2, the slant element identified at 26 will form an angle identified as a with the axis 28.

It has been found that if the angle a is less than about 15°, a wedging action between the frusto-conical bore portion 24 and the burning cigarette tip will occur. Similarly, if the angle a is greater than about 25°, a crushing action will occur. In either case, i.e., the wedging or crushing actions, the burning cigarette tip will tend to be broken up and the desired extinguishing characteristics of the device 10 will not be achieved. The ideal angle has been found to be about 21° to 22°, and in actual extinguisher devices that have been fabricated, the angle used is 21° 30′.

The lower end of the frusto-conical bore portion 24 opens into the upper end of a reduced diameter cylindrical bore portion 30 which allows any ashes which may be dislodged during cigarette extinguishing operations to fall clear of the device 10 through the open bottom end of the bore 30. It has been found that the axial length of the reduced diameter bore portion 30 will result in a longer cigarette extinguishing time if it is not of sufficient length. Although not critical, the axial length of the reduced diameter portion 30 of about half the diameter of the bore portion 20 is desirable to achieve optimum cigarette extinguishing time.

Figure 3:
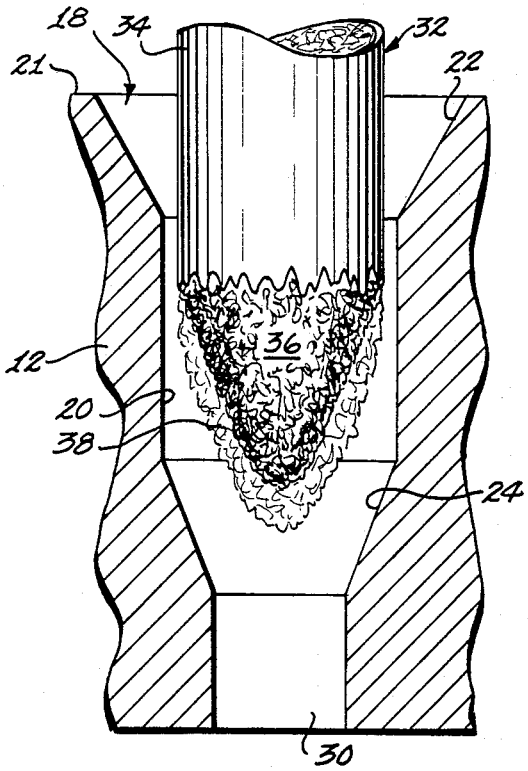
FIG. 3 is an enlarged fragmentary sectional view similar to FIG. 2 and showing a fragmentary view of a cigarette which is partially inserted therein for extinguishing purposes.

Reference is now made to FIG. 3 wherein a cigarette 32 to be extinguished is shown as being partially inserted into the bore 18 of the extinguisher device 10. The cigarette 32 has the usual substantially cylindrical body portion 34 with a burning tip 36 on its lower end. The burning tip 36 is seen to be of inverted conical configuration which, as hereinbefore mentioned, is the inherent shape of any normally burning cicarette. The burning cigarette tip 36 has a coating of ashes 38 thereon which more or less encapsulates the burning tip 36 in a very porous, almost fluffy, coating.

Figure 4:
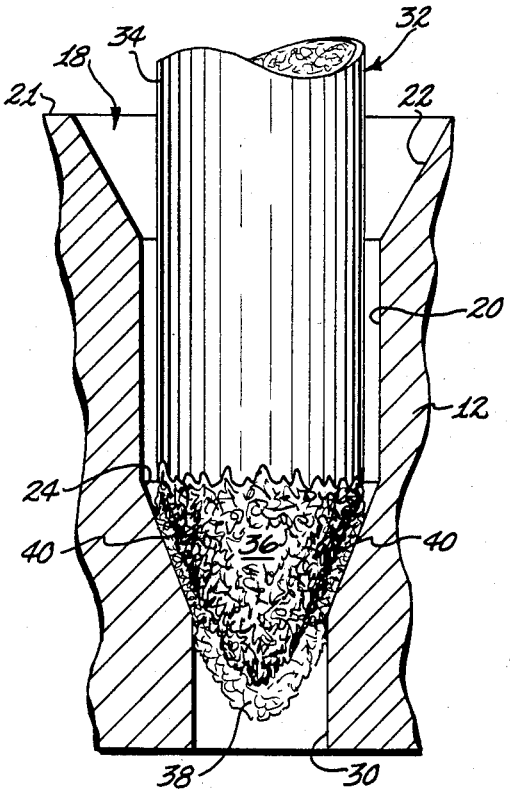
FIG. 4 is an enlarged fragmentary sectional view similar to FIG. 3 and showing the cigarette as being fully inserted therein.

FIG. 4 shows the cigarette 32 as having been inserted into the extinguishing position into the bore 18 of the device. It will be noted that such insertion is accomplished without exertion of any wedging or other downwardly applied forces beyond those required for the insertion. When the cigarette 32 is in the extinguishing position shown in FIG. 4, a large percentage of the area of the burning tip 36 and its ash coating 38 will nestingly rest on the endless slanting sidewall which defines the above described inverted frusto-conical bore portion 24. This nestingly rested positioning is, as hereinbefore described, believed to exert a compressing force on the greater area portion of the ash coating 38 as indicated at 40 in FIG. 4. The compacted ash coating combined with the inherent air flow restricting characteristics of the bore 18 will quickly starve the burning cigarette 36 of the required oxygen. And, additionally, the ash coating compacting action is believed to contribute to the rapid loss of combustion temperature of the burning cigarette tip.

An additional feature of the extinguisher device 10, which is believed to be a direct result of the above described extinguishing characteristics, is that a cigarette extinguished in the device 10 can be relit without the usual unpleasant taste which normally accompanies the relighting of a cigarette extinguished by any other technique known to us.

While the principles of the invention have now been made clear in an illustrated embodiment, there will be immediately obvious to those skilled in the art, many modifications of structure, arrangements, proportions, the elements, materials, and components used in the practice of the invention, and otherwise, which are particularly adapted for specific environments and operation requirements without departing from those principles. The appended claims are therefore intended to cover and embrace any such modifications within the limits only the true spirit and scope of the invention.

What we claim is:

1. A cigarette extinguishing device comprising:

(a) a housing having an upper surface and an opposed lower surface with a bore extending therebetween;

(b) said housing configured to provide said bore with a cylindrical bore portion the upper end of which opens onto the upper surface of said housing, said cylindrical bore portion adapted to removably receive the substantially cylindrical body portion of a cigarette to be extinguished;

(c) said housing configured to form a frusto-conical bore portion at the lower end of said cylindrical bore portion for nestingly receiving and circumscribingly engaging at least a portion of the conical surface of the burning tip of the cigarette removably receivable in said cylindrical bore portion; and (d) said housing configured to form a reduced diameter cylindrical bore portion which extends from said frusto-conical bore portion and opens onto the lower surface of said housing.

2. A cigarette extinguishing device as claimed in claim 1 wherein said frusto-conical bore portion is defined by said housing to substantially match the inherent shape of the burning tip of a cigarette removably receivable in said cylindrical bore portion whereby the nesting receipt of the burning tip of the cigarette will occur without crushing or otherwise breaking up the burning tip of the cigarette.

3. A cigarette extinguishing device as claimed in claim 1 wherein said frusto-conical bore portion is defined by said housing to substantially match the inherent shape of the burning tip of the cigarette nestingly receivable therein so that the nesting receipt will exert a cigarette ash compacting force thereon to substantially encapsulate the burning cigarette tip in a compacted cigarette ash coating.

4. A cigarette extinguishing device as claimed in claim 1 wherein said frusto-conical bore portion defined by said housing has its slant elements disposed to form an angle in the range of between 15° to about 25° with respect to the axis of said bore.

5. A cigarette extinguishing device as claimed in claim 1 wherein said frusto-conical bore portion defined by said housing has its slant elements disposed to form an angle in the range of between about 21° to about 22° with respect to the axis of said bore.

6. A cigarette extinguishing device as claimed in claim 1 wherein said frusto-conical bore portion defined by said housing has its slant elements disposed at an angle of 21° 30′ with respect to the axis of said bore.

7. A cigarette extinguishing device as claimed in claim 1 wherein the one end of said cylindrical bore portion which opens onto the one surface of said housing is chamfered to facilitate insertion of the cigarette to be inserted.

8. A cigarette extinguishing device as claimed in claim 1 wherein said cylindrical bore portion defined by said housing has an axial length which is sufficient to support the cigarette which is removably receivable therein.

9. A cigarette extinguishing device as claimed in claim 1 wherein said cylindrical bore portion defined by said housing has a diameter which allows free axial insertion of the cigarette which is removably receivable therein and restricts the free flow of air therethrough when the cigarette is removably received.

10. A cigarette extinguishing device as claimed in claim 1 wherein said reduced diameter bore portion defined by said housing has an axial length approximately equal to about half of the diameter of said cylindrical bore portion.

* * * * *